US005980145A

United States Patent [19]

Griffith

[11] Patent Number: 5,980,145

[45] Date of Patent: Nov. 9, 1999

[54] DISPOSABLE TOOTHBRUSH

[76] Inventor: Patrick Griffith, 1102 Shawnee Trail, Carrollton, Tex. 75007

[21] Appl. No.: 08/321,262

[22] Filed: Oct. 11, 1994

Related U.S. Application Data

[63] Continuation-in-part of application No. 08/144,060, Oct. 27, 1993, abandoned.

[51] Int. Cl.[6] ..... A46B 11/00

[52] U.S. Cl. ..... 401/123; 401/132; 401/268

[58] Field of Search ..... 401/123, 124, 401/125, 132, 268; 132/308, 311; 15/167.1

[56] References Cited

U.S. PATENT DOCUMENTS

| | | | |
|---|---|---|---|
| 246,934 | 9/1881 | Arment et al. . | |
| 901,835 | 10/1908 | Ringer . | |
| 958,371 | 5/1910 | Danek | 15/167.1 |
| 1,420,581 | 6/1922 | Schoneman . | |
| 1,642,620 | 9/1927 | Merrill | 132/311 |
| 2,105,709 | 1/1938 | Violette | 401/123 X |
| 2,199,877 | 5/1940 | Cervera | 132/311 |
| 2,223,484 | 12/1940 | Engelbreit . | |
| 2,324,789 | 7/1943 | Mayeux . | |
| 2,474,860 | 7/1949 | Perwas . | |
| 2,630,812 | 3/1953 | Dendy . | |
| 2,733,722 | 2/1956 | Rodd . | |
| 2,968,827 | 1/1961 | Lawsine et al. . | |
| 3,103,224 | 9/1963 | Dearling . | |
| 3,356,095 | 12/1967 | Tylle | 401/134 X |
| 3,593,725 | 7/1971 | Ortega . | |
| 3,842,851 | 10/1974 | Pipitone . | |
| 4,527,574 | 7/1985 | Manfredi . | |
| 4,530,129 | 7/1985 | Ladick et al. . | |
| 5,123,765 | 6/1992 | O'Connell et al. . | |
| 5,144,712 | 9/1992 | Hansel et al. . | |

FOREIGN PATENT DOCUMENTS

| | | | |
|---|---|---|---|
| 416165 | 10/1910 | France | 132/311 |
| 2475378 | 8/1981 | France | 461/287 |
| 2546046 | 11/1984 | France | 401/132 |
| 2658400 | 8/1991 | France | 401/123 |
| 3616182 | 12/1986 | Germany | 401/134 |
| 363821 | 12/1931 | United Kingdom | 401/124 |

*Primary Examiner*—Steven A. Bratlie
*Attorney, Agent, or Firm*—Marc A. Hubbard; Munsch Hardt Kopf & Harr, P.C.

[57] ABSTRACT

A disposable toothbrush, comprising a first section (12) having a first proximate end (16) and a first distal end (18), a second section (22) having a second proximate end (28) and a first distal end (25), a plurality of bristles (20) coupled to the first distal end (18), a plug (30) sealingly disposed within the second section (22) and thereby forming a compartment (26) within the second section (22) between the plug (30) and the second proximate end (28), a quantity of powdered dentifrice disposed within the compartment (26) and a sealing means (32) sealingly disposed on the second proximate end (28) in order to seal the compartment (26) wherein the first proximate end (16) has a smaller cross-sectional dimension than the second distal end (25) so that the first section (12) may be placed in frictional, sliding engagement with the second section (22) when the first proximate end (16) is inserted into the second distal end (25).

2 Claims, 2 Drawing Sheets

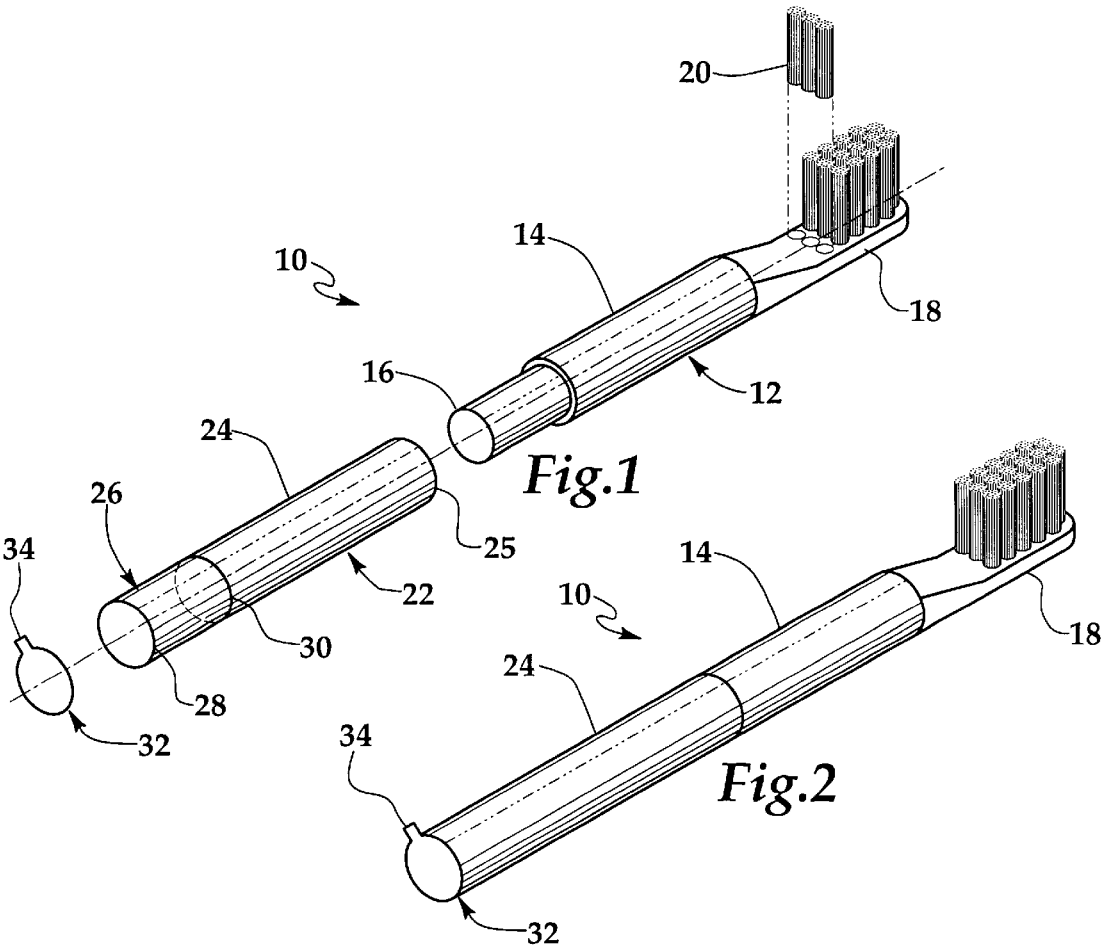
Fig.1
Fig.2
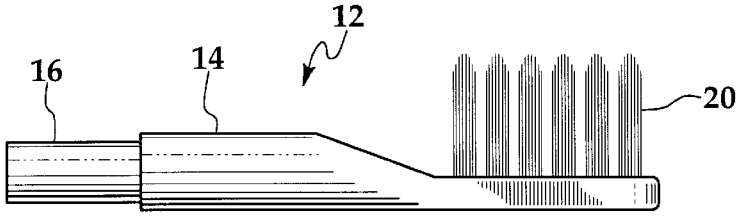
Fig.3
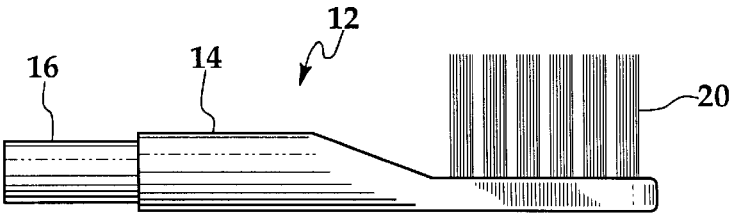
Fig.4

DISPOSABLE TOOTHBRUSH

This application is a continuation-in-part of Ser. No. 08/144,060, filed Oct. 27, 1993, now abandoned which application is incorporated herein by reference.

TECHNICAL FIELD OF THE INVENTION

The present invention relates generally to oral hygienic devices, and more particularly relates to disposable toothbrushes containing powered dentifrice.

BACKGROUND OF THE INVENTION

It is well known that pathogenic organisms thrive on the bristles of conventional toothbrushes and it has been established that the toothbrush is responsible for the transmission of various infections. Various pathogenic organisms such as bacteria, fungi, yeasts and viruses can remain alive on a moist toothbrush for up to a week The toothbrush is used in the mouth, which is a known bacteria containing area and the moist and humid environment of the bathroom in which the toothbrush is usually stored assists, and in some cases accelerates, microbial growth.

Cleaning the conventional toothbrush by a simple "rinse and tap" method is generally ineffective in removing toothpaste residue, saliva and food debris trapped in the bristles or tufts, all of which provide an environment to maintain pathogenic organisms alive until the next use of the toothbrush. Potential cross-contamination results from the maintenance of these pathogenic organisms on the toothbrush.

It has also been recognized that it is desirable to brush the teeth at more frequent time intervals than is routinely done, such as after every meal However, this is difficult to accomplish since individuals usually do not have tooth brushing equipment available throughout a work day, when travelling, dining out, or the like. There have been efforts made to provide a collapsible or travelling toothbrush, some of which are also provided with a supply of dentifrice. However, many such devices are relatively bulky and not disposable, which does not overcome the problem of maintenance of pathogenic organisms on the toothbrush from one brushing to the next. Other such devices are designed to be disposable, however they are not compatible with the use of a powdered dentifrice.

SUMMARY OF THE INVENTION

The present invention overcomes the disadvantages of the prior art devices by providing a compact, disposable toothbrush in a sanitary package with a supply of powdered dentifrice sufficient for one brushing. Additionally, the invention has the advantage of a structure adapted to minimize cost using conventional, low-cost plastic molding techniques.

In one form of the invention, a disposable toothbrush includes a handle portion and a brush portion formed with bristles. A hollow compartment is formed in the handle portion and filled with a quantity of dentrifice sufficient for one brushing. An opening to the compartment in one end of the handle sealed The two halves of the toothbrush are packaged so that they can be carried on a person or in a handbag while remaining sanitary. When a person desires brushing, the seal is removed and the powdered dentrifice poured onto the bristles. The brush end includes a tongue having cross-sectional dimensions approximately the same as those of the compartment. After the dentrifice is poured onto the bristles, the person slides the tongue into the compartment to establish a friction fit connection.

According to other aspects of the invention, the top of the bristles are flat for retaining powdered dentrifice nearer the teeth when brushing. The handle portion of the toothbrush is contoured for firmer gripping of the relatively short handle of the toothbrush and for more control over the brush and the pressure applied by the bristles to the teeth.

BRIEF DESCRIPTION OF THE DRAWINGS

The novel features believed to be characteristic of the invention are set forth in the appended claims. For a more complete understanding of the present invention, and for further details and advantages thereof, reference is now made to the following Detailed Description taken in conjunction with the accompanying drawings, in which:

FIG. 1 is an exploded isometric view of a first embodiment of the present invention;

FIG. 2 is an isometric view of a first embodiment of the present invention;

FIG. 3 is a plan view of a first embodiment of the present invention; and

FIG. 4 is a plan view of a second embodiment of the present invention.

Figure 5:
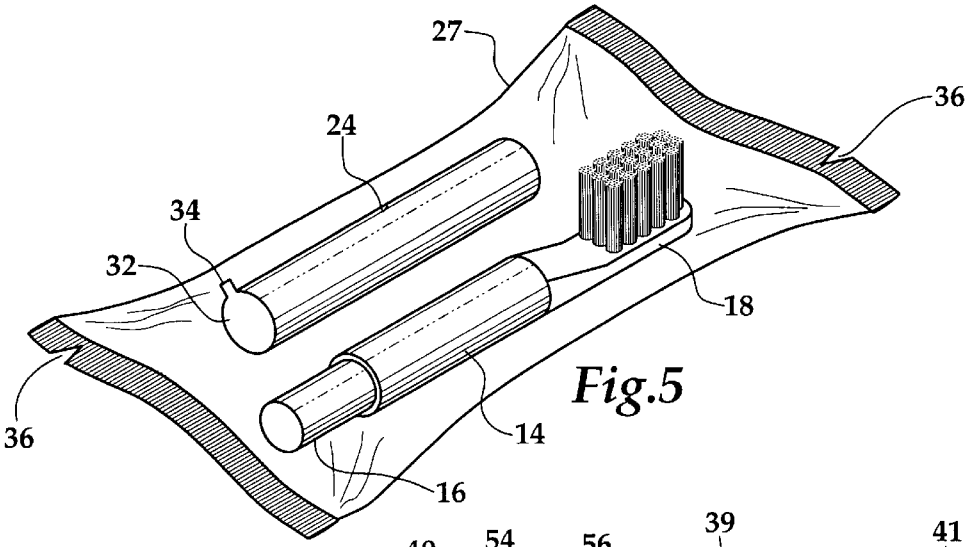
FIG. 5 is a perspective view of a packaged toothbrush.

It is to be expressly understood, however, that the drawings are for purposes of illustration only and are not intended as a definition of the limits of the invention. Such definition is made only by the appended claims.

DETAILED DESCRIPTION OF THE DRAWINGS

A disposable toothbrush in accordance with the present invention is shown schematically in FIG. 1 and indicated generally at 10. A head end 12 of toothbrush 10 is formed by a tubular stem 14 which preferably has a circular transverse cross-section. A proximate end 16 of stem 14 has a reduced cross-sectional diameter. A distal end 18 of stem 14 is adapted to receive a plurality of bristles arranged into a plurality of tufts 20. In a preferred embodiment, there are 24 bristles per tuft 20 and the tufts 20 are arranged into a grid of 3 tufts by 5 tufts It will be appreciated by those skilled in the art that details such as the number of bristles per tuft, or the number or arrangement of the tufts 20, are mere design choices and the present invention comprehends any such arrangement. Distal end 18 of stem 14 may be flattened to a substantially rectangular transverse cross-section, or it may maintain the same transverse cross-section configuration of the remainder of stem 14. The bristles and tufts 20 are secured to the stem 14 in any manner as is commonly known in the art.

A handle end 22 of toothbrush 10 is formed from a tubular housing 24 having substantially the same transverse cross-sectional diameter and shape as the stem 14. The transverse cross-sectional diameter of proximate end 16 is such that it may slidingly engage the distal end 25 of housing 24 and provide a frictional fit thereto, such that stem 14 and 24 will remain engaged until some external force is applied to separate them. The provision of a frictional fit between housings 14 and 24 is an important improvement over prior art devices which used screw mechanisms or keyed systems. The use of frictional coupling allows relatively inexpensive fabrication methods to be employed in the manufacture of the toothbrush 10 and makes assembly of the toothbrush 10 easier. The cost reductions thereby achieved are very important in making the toothbrush 10 economical since it is intended to be disposable.

The hollow interior of housing 24 is used in the present invention to hold a supply of powdered dentifrice. A compartment 26 is formed in the proximate end 28 by the interposition of a plug 30 within the housing 24. Plug 30 may be formed as a part of the housing 24 during manufacture thereof, such as by injection molding the tubular housing with an integrally formed wall transversely disposed within the hollow interior of the housing. Alternatively, plug 30 may be formed as a separate piece, such as a quantity of wadding material and stuffed into a housing cut from a length of extruded tubing. It is only necessary that the plug 30 effectively seal the compartment 26 from the remainder of the housing 24. The presence of plug 30 allows a quantity of powdered dentifrice (not shown) to be placed into compartment 26 at the time of manufacture of toothbrush 10. Preferably, enough dentifrice for a single use is placed within compartment 26, so that toothbrush 10 may be disposed after use. This prevents the growth of pathogenic organisms on the tufts 20. After a quantity of dentifrice is placed into compartment 26, the opening of compartment 26 is sealed by a closure seal 32, which is placed over the opening of compartment 26, thereby preventing the escape of the powdered dentifrice until the seal 32 is removed by the consumer. Preferably, the seal is hermetic and is formed from foil or some other type of flexible sheet material This is attached to the edges of the opening with adhesive or other methods known in the art for allowing the seal 32 to be easily removed by a consumer. A tab 34 is preferably formed on seal 32 so that it may be grasped by the consumer to remove the seal.

Referring now to FIG. 2, the toothbrush 10 is shown in its assembled form, with stem 14 and housing 24 engaged with one another. It is intended that the toothbrush 10 will be sold with stem 14 and housing 24 disengaged so that toothbrush 10 will form an extremely compact unit before use. The unit is made most compact by making the length of housing 24 approximately equal to the distance between the proximate end 16 and the first row of tufts 20 on stem 14, and making its diameter approximately equal to the height that the tufts 20 extend above the surface of stem 14. This allows the housing 24 to be packaged alongside the stem 14 without increasing the package size. Such compactness facilitates the convenient carrying of toothbrush 10 in a pocket or purse without weight or bulk and thus promote more frequent brushing.

In order to use the toothbrush 10, the consumer retrieves the toothbrush 10 in its unassembled form, removes the seal 32, pours the powdered dentifrice within compartment 26 onto the tufts 20, assembles stem 14 with housing 24 by sliding proximate end 16 into distal end 25, grasps housing 24 and then brushes his or her teeth as normal. After brushing, the toothbrush 10 may be disposed, thereby preventing the spread of pathogenic organisms during the next brushing. Because of this hygienic advantage, the present invention is useful not only away from home, but also within the home, since using a new toothbrush for every brushing prevents the spread of pathogenic organisms by the toothbrush.

Referring now to FIG. 3, there is illustrated a first embodiment of the tufts 20 of the present invention. As can be seen from the illustration, the bristles in each tuft are staggered in height such that the bristles in the center of the tuft 20 extend to a greater height than do the bristles at the perimeter of the tuft 20. This is the tuft configuration of prior art toothbrushes, but it does not lend itself well to the application of powdered dentifrice because the sloped upper surface of each tuft 20 encourages the powder to fall down between the tufts. It is recognized that the powdered dentifrice is most effective when it remains on top of the tufts 20 and is applied directly to the teeth. Although some of the dentifrice that falls between the tufts 20 will work its way up into contact with the teeth during brushing, much of it will not. Not only does this result in waste of that quantity of dentifrice which is not used to advantage, but it also results in a less effective cleaning of the teeth.

Referring now to FIG. 4, there is illustrated a second embodiment of the tufts 20 of the present invention which overcomes this problem. In the second embodiment, each bristle of each tuft 20 is formed to extend to the same height as every other bristle. The aggregate effect is the provision of a flat surface for the application of the powdered dentifrice from compartment 26. Because the bristles all extend to the same height, there is no tendency to force the dentifrice down between the tufts 20, so that the great majority of the dentifrice remains on top of the tufts 20 and is applied directly to the teeth when brushing. This results in a more efficient use of the dentifrice as well as a more effective brushing.

Referring now to FIG. 5, head end 12 and handle end 22 of toothbrush 10 are inserted into hermetically sealed package 27. Packaging of the toothbrush is preferably done under sanitary conditions so that the toothbrush remains sanitary. The sealed packaged may be inflated to cushion the toothbrush and protect its bristles from being crushed. Individually packaged toothbrush 10 can then be sold either individually or in a box and carried on a person in a sanitary, protected state until ready for use. The package 27 includes notches 36 for enabling a person to open the package by hand without aid of scissors or a knife. Once the package is opened and the handle end 22 and the head end 12 removed, dentrifice is poured on to the bristles and the toothbrush is assembled as previously described.

Figure 6:
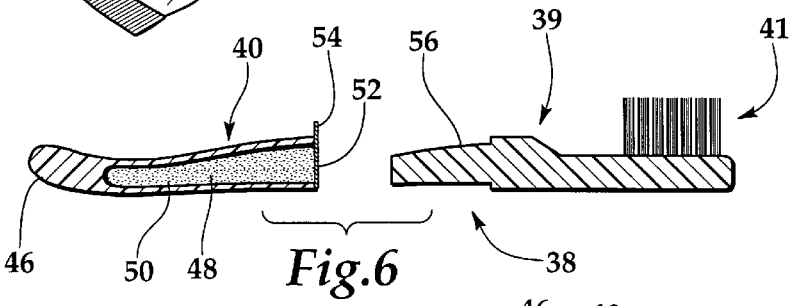
FIG. 6 is a cross-section of an alternate embodiment of a disassembled toothbrush according to the invention.

Referring to FIG. 6, an alternate embodiment of a disposable toothbrush 38, shown disassembled, includes two halves: a brush portion 39 with bristles 41; and a handle portion 40. Although not shown, the two halves of toothbrush 38 are packaged in a hermetically sealed package in a manner substantially similar to that shown in FIG. 5 for one-time use. Handle portion 40 is a molded plastic part in which is integrally formed a compartment 48. Compartment 48 is open only at one end of handle 40, tail 46 of the handle is closed. The compartment 48 is filled with a supply of powdered dentrifice 50 approximately sufficient for one brushing. The opening of the compartment is sealed with a removable and non-replaceable adhesive sheet 52 with a portion thereof 54 extending beyond the outer periphery of the handle to form a tab for grabbing by fingers to peal away the seal. Preferably the seal is water-tight and air-tight to preserve the powdered dentrifice in a sanitary state. The brush portion 39 of the toothbrush is molded from plastic and includes an elongated tongue 56 having a shape and dimensions complementing that of the inside walls of compartment 48. To assemble the two halves of the toothbrush, the tongue slides into the compartment and establishes a close frictional fit. The cross-section of the tongue and the compartment have substantially square shapes to prevent rotation of the handle end with respect to the brush end once assembled.

Figure 7:
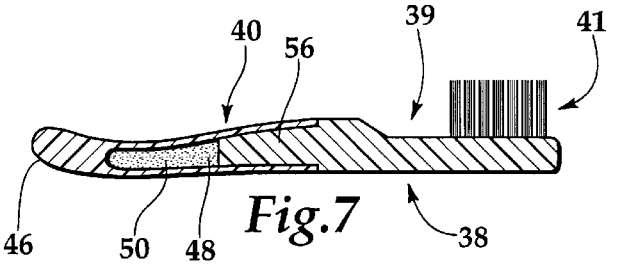
FIG. 7 is a cross-section of the toothbrush of FIG. 6 with an alternate sealing arrangement.

Referring now to FIG. 7, an alternate method of sealing a supply of powdered dentrifice 50 within compartment 48 is to insert tongue 56 into compartment 48 and wrap adhesive tape (not shown) around the joint between the brush end and the handle end. The quantity of powdered dentrifice must, however, be decreased in order to accommodate the tongue.

Figure 8:
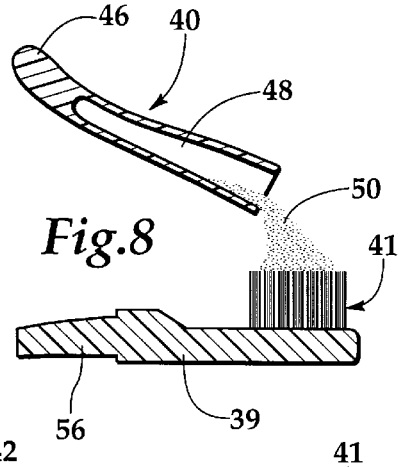
FIG. 8 is a cross-section of the toothbrush of FIGS. 6 and 7.

Referring now to FIG. 8, when brushing is desired, a package (not shown) is opened and the handle and the brush portions of toothbrush 38 are removed. In the case of the embodiment shown in FIG. 6, seal 52 is removed and the powdered dentrifice poured from compartment 48 onto the bristles 41. In the case of the embodiment of FIG. 7, the tape (not shown) wrapped around the joint is removed and the handle end, the brush end separated, and the dentrifice poured from the compartment in the handle end onto the bristles. The toothbrush is then assembled by sliding tongue 56 of the brush end into compartment 48 of the handle end 40.

Figure 9:
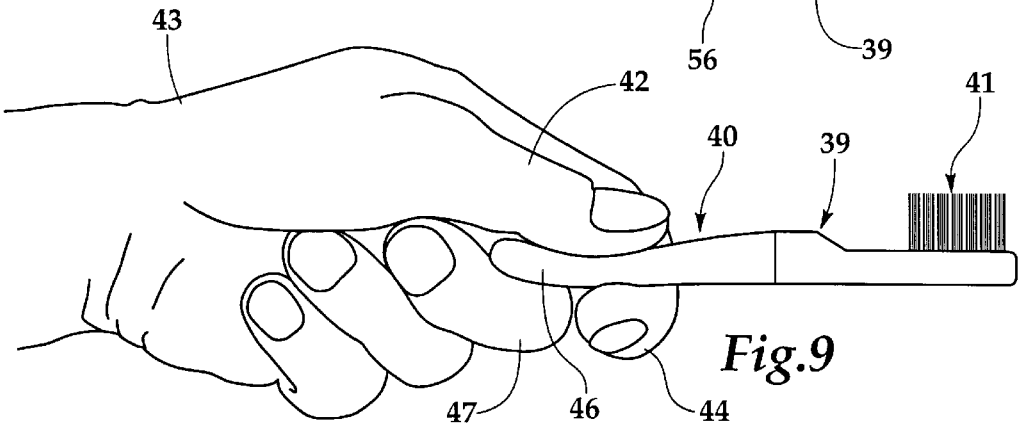
FIG. 9 is a side view of the toothbrush of FIGS. 6, 7 and 8 that is assembled and being held.

As shown in FIG. 9, handle end 40 is contoured to fit a hand when it is gripped between the thumb 42 and the index finger 44 for brushing. The toothbrush is, as compared to human hand 43, comparatively small and compact and thus cannot be gripped for brushing as easily as a conventional toothbrush. A slight depression is provided in the handle portion where the thumb rests and tail 46 is curled upward slightly for accommodating the middle finger 47 in manner that enables it to assist in apply a leveraging force to the toothbrush about the point at which the index finger and thumb squeeze the handle. The handle may thus be gripped comfortably and firmly to counter forces applied to the bristles 41 during brushing.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the appended claims.

What is claimed is:

1. Disposable tooth cleaning apparatus comprising:

an elongated brush portion having proximate and distal ends, the proximate end including a plurality of bristles, the plurality of bristles having ends which collectively form a substantially flat surface for receiving powdered dentifrice;

an elongated, substantially entirely rigid, handle portion having proximate and distal ends and a compartment defined therein for holding a supply of powdered dentifrice sufficient for substantially one brushing, the proximate end of the handle portion having defined therein an opening through which the dentifrice may be poured from the compartment onto the bristles immediately prior to use and within which a segment of the distal end of the brush portion is received for connecting the brush portion and handle portion for use; and means for sealing the opening for subsequent manual unsealing, wherein the means for sealing includes a flexible material extending across the opening and attached with an adhesive for one-time removal.

2. Disposable tooth cleaning apparatus comprising:

an elongated brush portion having proximate and distal ends, the proximate end including a plurality of bristles, the plurality of bristles having ends which collectively form a substantially flat surface for receiving powdered dentifrice;

an elongated, substantially rigid, handle portion having proximate and distal ends and a compartment defined therein for holding a supply of powdered dentifrice sufficient of substantially one brushing, the proximate end of the handle portion having defined therein an opening through which the dentifrice may be poured onto the bristles immediately prior to use and within which a segment of the distal end of the brush portion is received for connecting the brush and handle portions together for use; the distal end of the handle portion being curved upwardly such that a thumb fits within the curve and a third finger of a hand fits under the curved distal end opposite the thumb when the handle is manually grasped and oriented for brushing;

a quantify of powdered dentifrice disposed within the compartment sufficient for substantially one brushing; and means for sealing the opening for subsequent manual unsealing, wherein the means for sealing includes a flexible material extending across the opening and attached with an adhesive for one-time removal.

* * * * *